US005116153A

United States Patent [19]

Tully

[11] Patent Number: 5,116,153

[45] Date of Patent: May 26, 1992

[54] MULTIPLE LINE WRITING INSTRUMENT

[76] Inventor: Paul R. Tully, 42 Windward Rd., Lowell, Mass. 01852

[21] Appl. No.: 678,145

[22] Filed: Apr. 1, 1991

[51] Int. Cl.[5] ..... B43K 27/08; B43L 13/02

[52] U.S. Cl. ..... 401/35; 401/28; 401/29; 33/41.4; 33/44

[58] Field of Search ..... 33/41.4, 44, 18.1, 21.3; 401/35, 29-33, 28, 36, 37, 34

[56] References Cited

U.S. PATENT DOCUMENTS

| | | | |
|---|---|---|---|
| 207,883 | 9/1978 | McGee | 33/41.4 |
| 425,495 | 4/1990 | Demarest | 33/41 |
| 1,191,725 | 7/1916 | Paulsen | 33/41 |
| 1,731,395 | 10/1929 | Radtke | 33/41 |
| 1,858,881 | 5/1932 | Caruana | 401/33 |
| 2,466,464 | 4/1949 | Moore | 33/21.3 X |
| 3,164,906 | 1/1965 | Andaloro | 33/41 |
| 3,405,447 | 10/1968 | Pfeffer | 33/41 |
| 3,518,017 | 6/1970 | Schmidt | 401/33 X |
| 3,750,292 | 8/1973 | Dodge | 33/41.4 |
| 3,753,384 | 8/1973 | Anfindsen | 33/18.1 |
| 3,762,054 | 10/1973 | Ballard | 33/41 |
| 4,878,669 | 11/1989 | Premysl | 401/35 X |

FOREIGN PATENT DOCUMENTS

| | | | |
|---|---|---|---|
| 1348135 | 3/1974 | United Kingdom | 401/35 |

*Primary Examiner*—Danton D. DeMille
*Attorney, Agent, or Firm*—Barry R. Blaker

[57] ABSTRACT

Disclosed herein is a multiple line writing instrument which is adapted for one-handed operation in the general manner of an ordinary pen or pencil and which accomodates variations in the writing angle at which the instrument may be applied to a writing surface. The instrument includes plural elongate writing means, such as pens, held in parallel, spaced apart array. By means of a pivotal stop table the writing tips of the plural writing means are held in continous writing contact with a writing surface despite variations in writing angle which may occur during use. The multiple line writing instrument avoids the necessity to employ biasing elements, such as springs, to maintain writing contact of the writing tips with the writing surface.

14 Claims, 5 Drawing Sheets

MULTIPLE LINE WRITING INSTRUMENT

BACKGROUND OF THE INVENTION

1. Field of the Invention

The present invention relates broadly to the field of writing instruments and is more particularly concerned with hand manipulated writing instruments of the type whereby multiple lines are concomitantly applied to a writing surface with each stroke of the instrument.

2. Description of the Prior Art

Over the years many multiple-line drawing and writing instruments have been developed. In one general form of such writing instruments multiple pens are held in fixed array within a housing, the writing tips of the nibs of the pens being positioned in fixed coplanar relationship. Representative of such instruments are the devices disclosed in U.S. Pat. No. 3,164,906, to R.S. Andaloro, entitled "Multiple Pen Combination" and British Patent Specification No. 1,348,135, to W.C. Thomas, published Mar. 13, 1974, entitled "Improved Writing Implement". A problem associated with arrangements where the multiple pens are held in fixed planar array is that such instruments are incapable of adapting themselves to the various writing angles employed by the average population of users. Thus, the user must take care to manipulate such fixed nib devices at the precise writing angle relative to the writing surface at which each pen nib of the fixed array applies its respective ink burden to the writing surface. This manipulative requirement is, at the least, burdensome to the user and usually forecloses direct one-handed manipulation of such devices in the manner of an ordinary single pen or pencil.

Writing instruments adapted for one-, two-handed or machine use and in which accomodation of variations in writing angle can be had either inherently or intentionally have also been proposed. Representative of such instruments are those disclosed in the following U.S. Patent literature: U.S. 425,495, to Demarest, Apr. 15, 1890, entitled "Slate Ruler"; U.S. Pat. No. 1,191,725, to N. Paulsen, July 18, 1916, entitled "Drafting Instrument"; U.S. Pat. No. 1,731,395, to A. Radtke, Oct. 15, 1929, entitled "Instrument for Writing Characters on Advertising Boards"; U.S. Pat. No. 3,405,447, to J. Pfeffer, Oct. 15, 1968, entitled "Drafting Instrument" and U.S. Pat. No. 3,762,054, to A. Ballard, Oct. 2, 1973, entitled "Multi-Line Underlining Instrument". A feature common to each of the instruments disclosed in this patent literature is some form of holder means to retain a plurality of elongate writing means, such as chalks, pen nibs, pencil leads or the like, in parallel, spaced apart array. Furthermore, the holder means utilized in each of these instruments retains the writing means in a manner such that each writing means is imbued with the capacity to stroke upwardly and downwardly relative to both the holder means and to one another. Finally, also common to the instruments described in the above patent literature are biasing means, such as springs, by which each of the writing means of the instrument is independently and continuously urged to the extended stroke condition, that is to say, to the downwardmost stroke position thereof. Said biasing means, of course, serve to maintain each of the plural writing means of the respectively disclosed instruments in continuous writing contact with the writing surface during manipulation of the instrument.

I have found that the biasing means employed in constructions of the type exemplified by the patent literature referenced above represent a substantial complexity in the design, manufacture and assembly of such instruments and, therefore, constitute a significant fraction of the manufacturing costs thereof. Moreover, the overall pressure exerted by said biasing means, particularly with respect to those writing instruments intended to be manipulated by one hand, is necessarily reflected into the hand of the user and can be found to be of sufficient magnitude as to constitute a source of discomfort to the user and/or to adversely affect the accuracy at which the instrument can be manipulated. In accordance with the present invention, however, I have designed an improved multiple line writing instrument for one-handed operation which effectively accomodates variations in the writing angles at which it may be used but which avoids the operational liabilities and the complexities and incremental costs of manufacture associated with those prior art devices which depend upon the presence of biasing means to achieve this functional purpose.

SUMMARY OF THE INVENTION

In accordance with the present invention there is provided a multiple line writing instrument for one-handed manipulation comprising an instrument enclosure containing therein multiply apertured holder means. Said holder means slidingly receives through the multiple apertures thereof a corresponding plurality of elongate writing means whereby said plural elongate writing means are established in a spaced apart parallel array running longitudinally of the enclosure and whereby each writing means is enabled to independently stroke upwardly and downwardly therefrom. The writing tips of the elongate writing means extend to the exterior of the instrument enclosure. Critical to the instrument of the invention is a journalled stop table having one or more slots to slidingly receive each of the elongate writing means therethrough. The stop table is journalled in such manner that it can pivot in response to the writing angle at which the instrument is held with respect to a writing surface and maintain a parallel relationship with respect to said writing surface. Each of the plurality of elongate writing means is equipped with up stop means which cooperate with the journalled stop table, said stop means functioning to limit the upward stroke of said writing means to the position defined by said journalled stop table. With respect to the plurality of elongate writing means forming part of the invention the up stop means are located at equal distances from the writing tips thereof. Thus, when the instrument of the invention is applied to a writing surface at the writing angle of the particular user, the journalled stop table, acting under the influence of the forces applied thereto through the elongate writing means and up stop means, pivots to a plane parallel to the writing surface and, through the coaction thereof with said up stop means, maintains all of the writing tips of the elongate writing means array associated therewith in writing contact with the writing surface.

DESCRIPTION OF THE PREFERRED EMBODIMENTS

Figure 1:
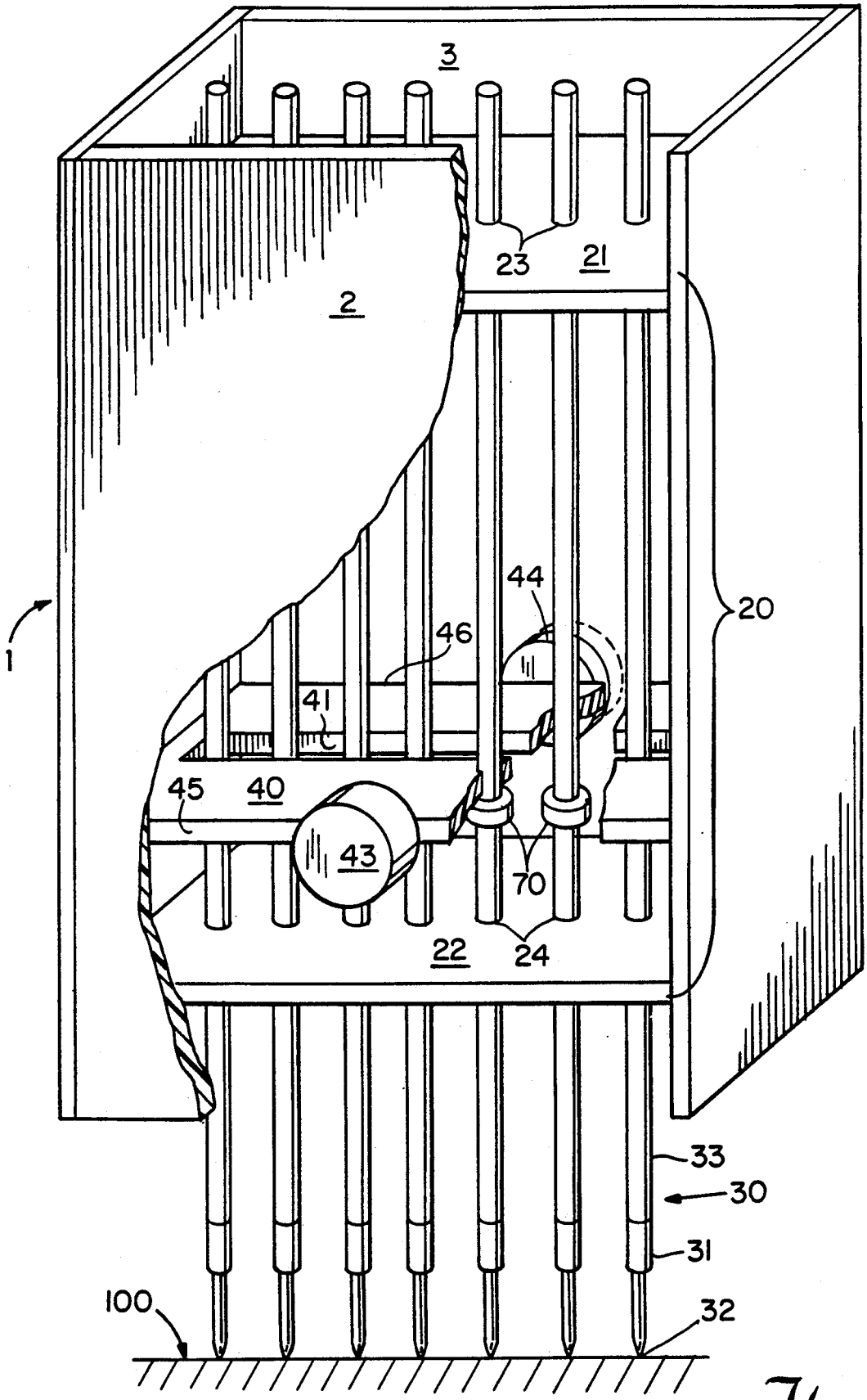
FIG. 1 is a schematic, isometric, partially sectional, drawing showing one embodiment of the invention wherein the plural spaced apart elongate writing means thereof are established in a linear array and wherein the gimballed stop table element is journalled to the instrument enclosure.

Referring now to FIGS. 1 through 6, wherein like reference numerals refer to like structures, the multiple line writing instrument of the invention broadly comprises an instrument enclosure 1 containing therein apertured holder means 20 which, in each of the embodiments shown, takes the form of a pair of spaced apart upper and lower retainer plates 21 and 22 secured transversely to the interior of enclosure 1. Said retainer plates 21 and 22 have a plurality of corresponding upper and lower apertures 23 and 24 therethrough, each pair of corresponding upper and lower apertures 23 and 24 slidingly receiving therethrough an elongate writing means 30. Substantially any type of elongate writing means, such as pens, pencils, crayons, chalks or the like can be employed in the construction of the instrument of the invention. However, I much prefer that the elongate writing means 30 be of a type whose overall length is not subject to change or wear during use thereof. Thus, I prefer that the elongate writing means 30 be in the nature of a pen having a self-contained ink supply and, of greatest preference, a ball point or felt tip pen comprising a pen nib 31 having a ball or felt writing tip 32 and an elongate cylindrical ink barrel 33. Where the instrument is to be utilized for drafting or other practical purposes the plurality of elongate writing means 30 defining the writing array preferably produce lines of the same color. However, where the instrument is to be utilized as a toy, novelty item or for artistic effect, it is contemplated that the elongate writing means 30 of the array produce lines of different coloration. In any event, as can be appreciated from the foregoing description, taken with the drawings hereof, the plural elongate writing means 30 of the invention are held longitudinally, in spaced apart, parallel array, by the corresponding upper and lower apertures 23 and 24 of upper and lower retainer plates 21 and 22 and are free to stroke upwardly and downwardly through said apertures 23 and 24.

An essential element in the multiple line writing instrument of the invention is a journalled stop table 40 which is journalled in such manner that it can freely pivot to maintain a parallel relationship thereof with a writing surface 100 despite variation in the writing angle at which the instrument is held with respect to said writing surface 100. Additionally, the stop table 40 comprises one or more slots 41 to slidingly receive each of the elongate writing means 30 therethrough. As will be discussed in more detail hereinafter, the number and orientation of said slots 41 employed are dependent upon the cross sectional geometry of the array of elongate writing means 30. Slots are required for the stop table 40 because, when the stop table pivots during use of the instrument of the invention, there occurs a lateral movement of at least some of the elongate writing means 30 relative to the slot(s) 41 in which they reside.

Figure 2:
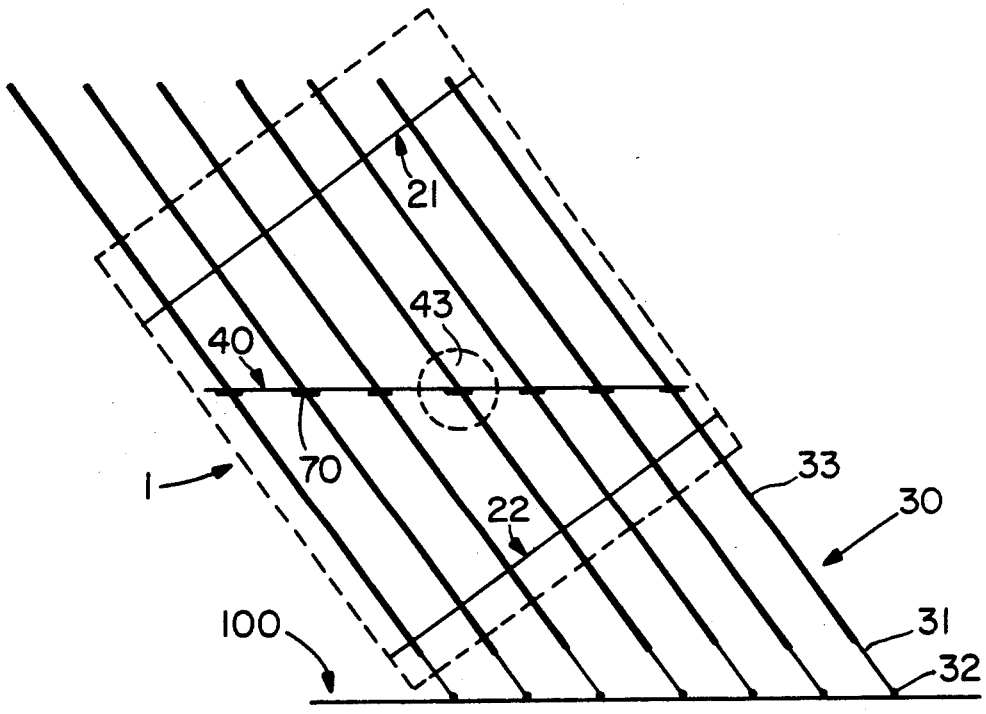
FIG. 2 is a schematic, partially phantom, side view of the embodiment of the invention shown in FIG. 1 held at a representative writing angle relative to a writing surface.
Figure 4:
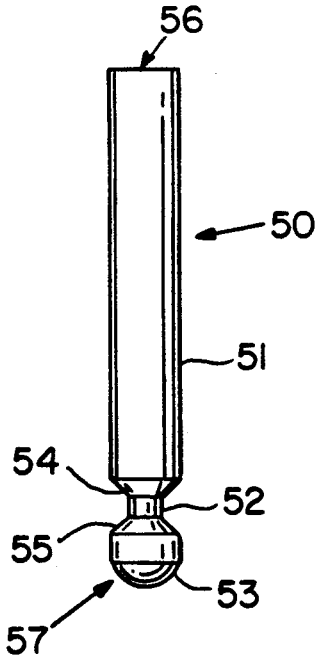
FIG. 4 is a side view of the center post structure of the embodiments of the invention shown in FIGS. 3, 5 and 6.

In the embodiment of the invention shown in FIGS. 1 and 2 the enclosure 1 is of oblong cross section. Thus, the instrument will inherently be manipulated with the wider opposed sides 2 and 3 of enclosure 1 held between the thumb and forefinger of the user, thereby assuring that the instrument will always be grasped in a particular rotational orientation about its longitudinal axis. Where the conformation of the writing instrument of the invention is such as to assure that it will be grasped by the user in a particular rotational orientation relative to its longitudinal axis, such as in the embodiment shown in FIGS. 1 and 2, the stop table 40 may be suitably journalled to the enclosure 1 so as to pivot about an axis transverse to the writing angle. For instance, as shown in FIGS. 1 and 2, oblong stop table 40 comprises a pair of opposed shaft segments 43 and 44 which are integral with and extend laterally from the geometric center of the side edges 45 and 46 of the stop table 40. Said shaft segments 43 and 44 are journalled in suitably sized opposed apertures in the midlines of the wider opposed side walls 2 and 3 of oblong enclosure 1. In the embodiments of the invention shown in FIGS. 3, 5 and 6, however, the enclosure 1 is of cylindrical conformation. In this case the user is not constrained to hold the device in any particular rotational orientation about its longitudinal axis. Where this circumstance occurs, the stop table 40 is journalled in such manner that it can pivot about its center and thereby pivot in any plane transverse to the longitudinal axis of enclosure 1 without regard to the rotational orientation of the device. This can be achieved by journalling the stop table 40 to a center post 50. Referring now particularly to FIG. 4, the center post 50 utilized in the embodiments of the invention shown in FIGS. 3, 5 and 6 comprises an elongate shaft 51 having a base end portion 56 and working end portion 57. The working end portion 57 of shaft 51 is formed to provide a terminal ball end 53 and an annular raceway 52 lying inboard of and adjacent the ball end 53. The diameter of raceway 52 is less than that of said shaft 51 and said ball end 53 and the shoulders 54 and 55 of said raceway 52 are conical or arcuate so as to define bearing surfaces for the stop table 40. In addition, the width of the annular raceway 52 is at least equal to the thickness of the stop table 40. The stop table 40 is provided with a central aperture 60 having a diameter intermediate the diameters of raceway 52 and the ball end 53. Assembly of the stop table 40 to the center post 50 is achieved simply by forcing the ball end 53 of the center post 50 through the aperture 60, thereby seating the stop table 40 in the raceway 52. In the embodiment of the invention shown in FIGS. 3 and 5 the base end 56 of shaft 51 is secured in a central aperture 25 of the lower fixed retainer plate 22 of the multiply apertured holder means 20 and depends therefrom, thereby positioning the stop table 40 at a spaced distance below the plate 22. In the embodiment of the invention shown in FIG. 6 the base end 56 of shaft 51 is also secured in a central aperture 25 of the lower fixed retainer plate 22, but extends upwardly therefrom, thereby positioning the stop table 40 at spaced distances between the lower fixed retainer plate 22 and the upper fixed retainer plate 21 of the multiply apertured holder means 20. This places the stop table 40 within the enclosure 1, spaced between the two fixed retainer plates defining the apertured holder means 20, thereby affording desirable and substantial physical protection of the stop table and its journalling mechanism. In any event, by the center post 50 journalling arrangements of the embodiments of the invention shown in FIGS. 3 through 6, it will be seen that the stop table 40 is afforded the capability to pivot in any plane with the edges of aperture 60 riding pivotally on the conical or arcuate surfaces of the shoulders 54 and 55 of the center post raceway 52.

Figure 3:
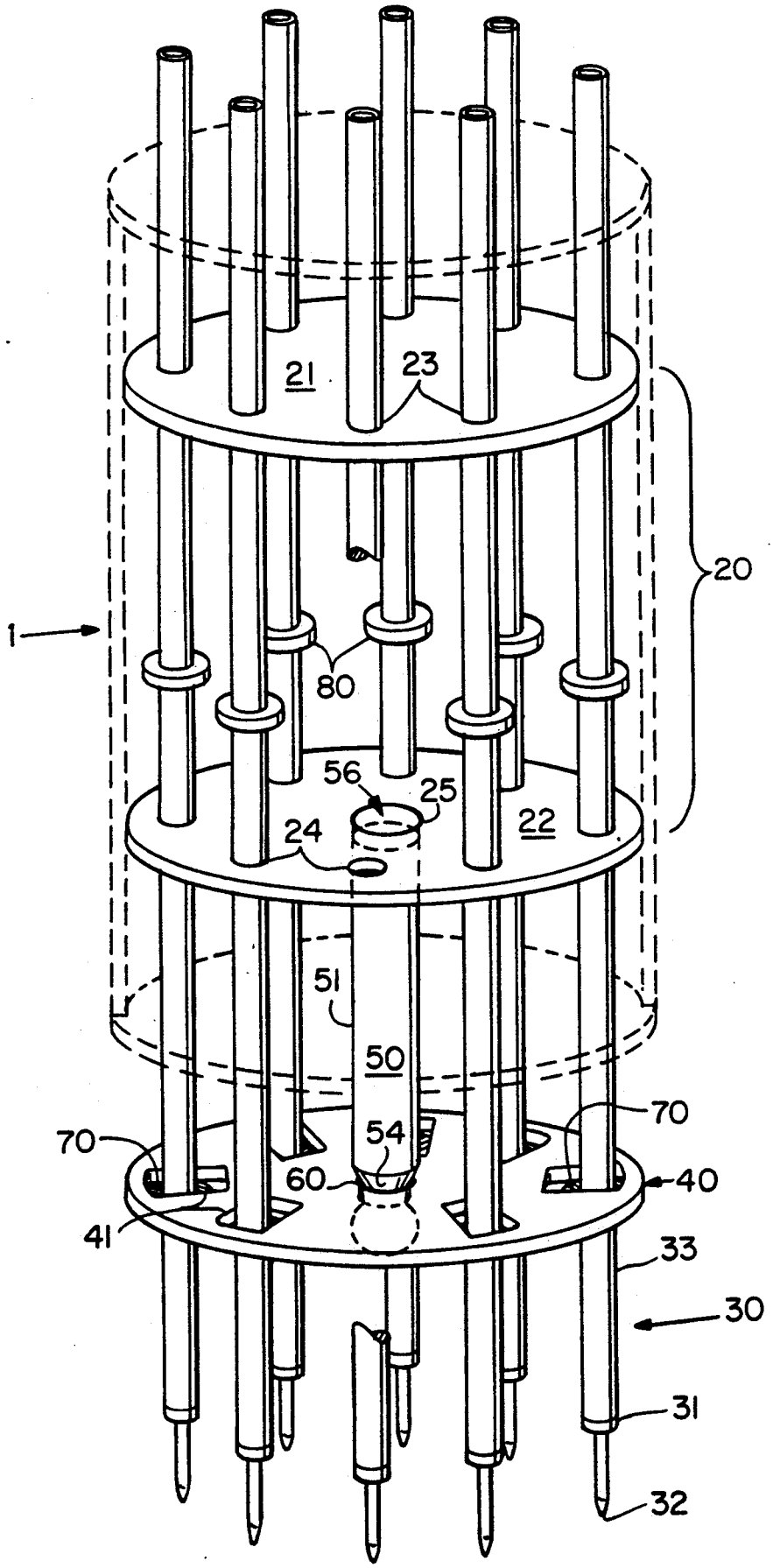
FIG. 3 is a schematic, partially phantom, isometric view of another embodiment of the invention wherein the plural elongate writing means thereof are established in a circular array and wherein the journalled stop table element thereof is external to the instrument enclosure and is journalled to a downwardly oriented center post structure.
Figure 5:
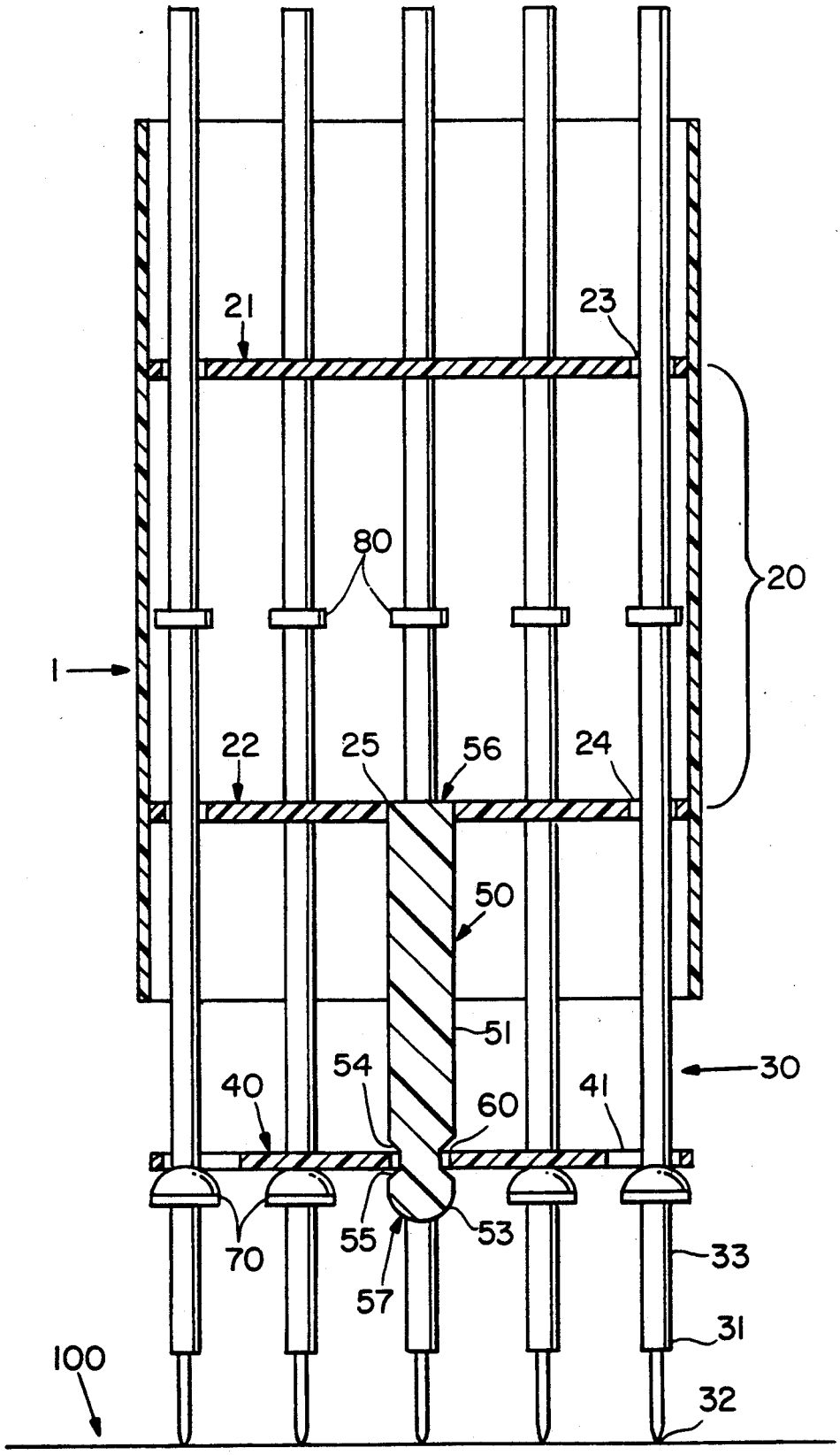
FIG. 5 is a schematic, longitudinal section of the embodiment of the invention shown in FIG. 3.
Figure 6:
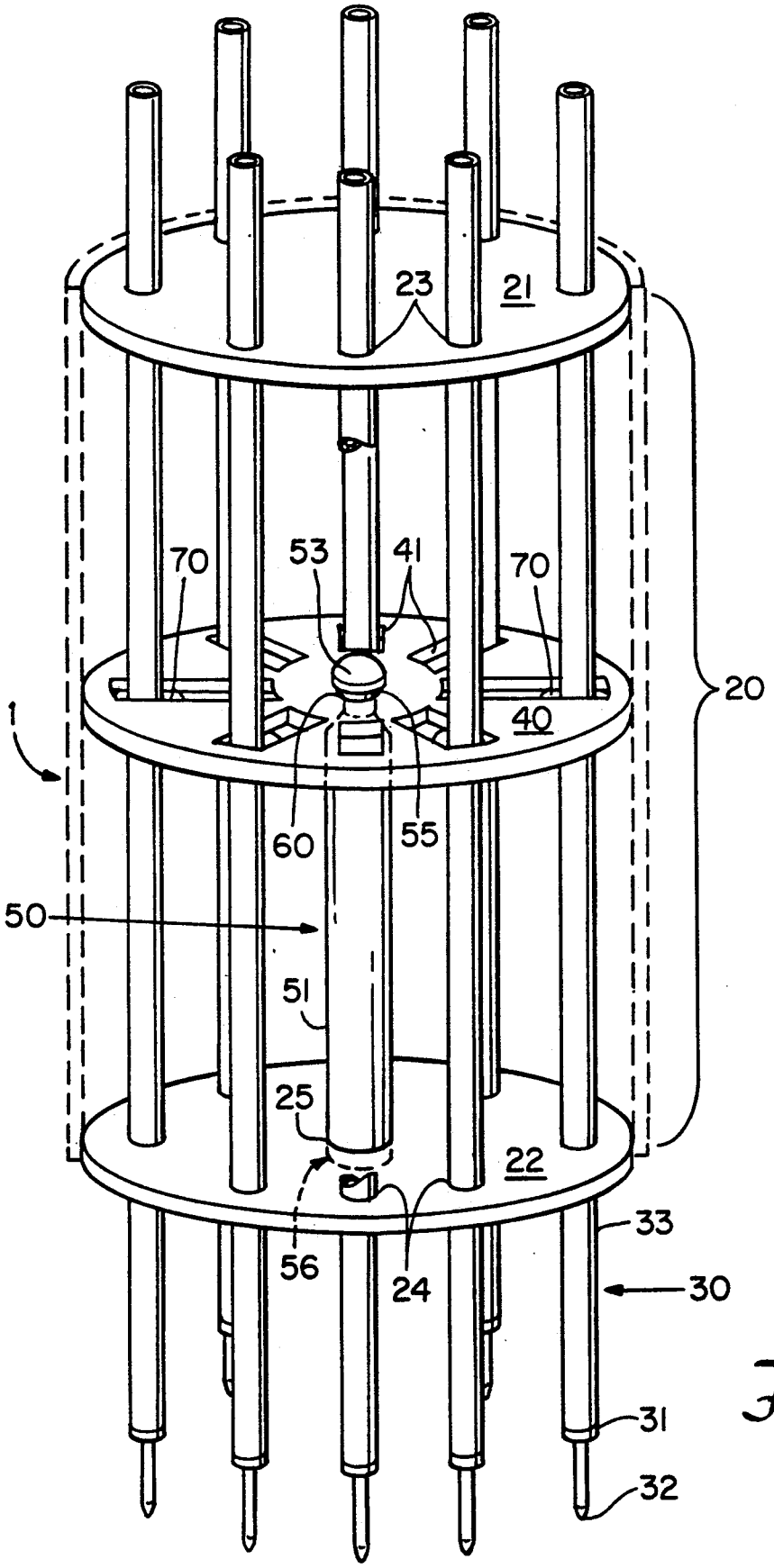
FIG. 6 is a schematic, partially phantom, isometric view of another embodiment of the invention wherein the plural spaced apart elongate writing means thereof are established in a circular array and wherein the journalled stop table element is positioned within the instrument enclosure and is journalled to an upwardly oriented center post structure.

In the embodiment of the invention shown in FIGS. 1 and 2, the elongate writing means 30 are arranged in a straight single row across the width of the instrument. Where this condition is met, a single slot 41 can be employed to slidingly embrace the plurality of elongate writing means 30 defining each said straight row. In the embodiments of FIGS. 3, 5 and 6, however, wherein the plurality of elongate writing means 30 defining the array are arranged in a single circular row surrounding the longitudinal axis of the stop table 40, a separate and distinct radially oriented slot 41 is provided for each elongate writing means 30. Such radially oriented slots 41 are required when the elongate writing means 30 are disposed in an array circumscribing the longitudinal center of the stop table 40 because it is in the nature of things that the lateral translation of the writing means 30 relative to the slots 41 in such arrays inherently occurs in a radial direction relative to the longitudinal axis of the stop table 40.

Each of the elongate writing means 30 is provided with an up stop means 70 located below the stop table 40. Said up stop means 70 is in the general nature of a localized widening of the elongate writing means 30 along the length thereof and of sufficient dimension as to butt against the bottom of the slot 41 and thereby define the up stroke limit of the elongate writing means 30. Thus, said up stop means 70 can take many specific forms, such as a grommet clinched about the circumference of the elongate writing means 30 or a ring section cemented, soldered or otherwise suitably secured about the circumference of the elongate writing means 30. The role of the up stop means 70 is, of course, to serve as an up stop for the stroke of the elongate writing means 30 associated therewith. In accordance with the invention, it is apparent that, where the bottom of the stop table 40 is flat, the distance between the writing tip 32 and the up stop means 70 of each elongate writing means 30 of the array should be equal, thereby to assure that all of the writing tips 32 be coplanar during writing operations. While the up stop means 70 may be composed of substantially any solid material capable of withstanding the loads imposed thereon during operations of the instrument of the invention, such as various metals and plastics, I generally prefer that the material of construction employed for said up stop means 70 be in the nature of a tough rubbery material having a certain degree of resiliency, whereby said up stop means can also serve as a vibration isolator to isolate the user from such vibrations as may be imposed upon the elongate writing means 30 as the writing tips 32 thereof are drawn across the writing surface 100.

Where the up stop means 70 are located between a stop table 40 and an apertured retainer plate 22 spaced below the table 40, as in the embodiments of the invention shown in FIGS. 1, 2 and 6, said up stop means 70 can also serve the function of a down stop and retaining means whereby the limit of the down stroke of each elongate writing means 30 and its retention in the construction is defined by butting of the stop means 70 against the upper surface of the apertured lower retainer plate 22. This is advantageous in terms of minimizing the number of elements and steps required to fabricate the invention and represents yet another reason underlying the desirability for positioning the stop table 40 intermediate spaced apart apertured upper and lower retainer plates 21 and 22. In the embodiment of the invention depicted in FIGS. 3 and 5, however, the stop table 40 and the up stop means 70 associated therewith are located below the enclosure 1 and the lower apertured retainer plate 22. Thus, in this embodiment, the up stop means 70 can not also serve as down stop and retainer means for the elongate writing means 30. Therefore, separate down stop and retainer means 80, which may be of similar or different construction and conformation from the up stop means 70, are shown provided on each of the elongate writing means 30 intermediate the spaced apart upper and lower apertured retainer plates 21 and 22. Alternatively, if desired, said down stop and retainer means 80 can be located above the upper apertured retainer plate 21.

Referring now to FIG. 2, which schematically depicts a representative operation of the embodiment of the invention of FIG. 1, the enclosure 1 of the multiple line writing instrument is grasped by the user in the general style of an ordinary pen or pencil and the writing tips 32 thereof are brought into contact with a writing surface 100. As will be appreciated by reference to FIG. 2, the first writing tip 32 of the elongate writing means 30 array to contact the writing surface 100 is at the left hand side of the instrument. As the instrument is depressed at the natural writing angle of the user into writing contact with the writing surface 100, the up stop means 70 of those elongate writing means 30 to the left of the pivot point defined by the journalled shaft segment 43 serially butt against the bottom of the stop table 40, thereby pivoting the table 40 to a plane which is parallel to and spaced above the writing surface 100. Meanwhile, the elongate writing means 30 to the right of the pivot point are leveraged downwardly by the action of the table against the up stop means 70, thereby downwardly forcing all of the writing tips 32 to the right of the pivot point into writing contact with the writing surface 100. The instrument is then drawn across the writing surface 100 and, despite such variations in writing angle as may occur during the writing stroke, all writing tips 32 of the instrument are maintained in writing contact with the writing surface 100 through the continuous pivotal accomodation of such variations by the stop table 40 acting upon the elongate writing means 30 through the up stop means 70.

While particular embodiments of the present invention have been shown and described above, it is apparent that many changes, additions and equivalent modifications in construction and arrangement can be made therein without departing from the essential scope and spirit thereof. For instance, while the apertured holder means 20 of each of the embodiments of the invention shown in the drawings hereof are shown and described as a pair of spaced apart separate and distinct apertured retainer plates 21 and 22, it is obvious that said holder means 20 can also take the form of a single elongate plug secured within the enclosure 1, said plug being provided with multiple apertures in a suitable array through the length thereof to receive the elongate writing means 30 therethrough. Accordingly, it is intended, and should be so understood, that the foregoing description is to be regarded as illustrative of the principles of the invention and of certain embodiments thereof and not in a limiting sense.

What is claimed is:

1. A multiple line writing instrument of a size and shape for one-handed use thereof, said instrument comprising: an enclosure having secured therein holder means comprising multiple apertures, each said aperture receiving in sliding relationship therethrough an elongate writing means having a writing tip whereby said multiple elongate writing means are established in a spaced apart parallel array oriented longitudinally of said enclosure, the writing tips of said array extending to the exterior of said enclosure and whereby each said elongate writing means is enabled to stroke upwardly and downwardly of said holder means; a journalled stop table secured to said enclosure and having a least one slot therethrough to slidingly receive each said elongate writing means of said array, said stop table being journalled so as to pivot transversely with respect to the longitudinal axis of said enclosure and responsively to upwardly directed forced imposed thereupon by at least certain of said elongate writing means when the instrument is held at a writing angle with respect to a writing surface and the plural writing tips of the elongate writing means array are contacted with said writing surface, and (b) to pivot sufficiently in accordance with (a) as to establish and maintain a parallel relationship to said writing surface; and up stop means affixed to each elongate writing means of said array at a distance from the writing tip thereof, said up stop means butting against the bottom of said stop table upon upward stroking of the writing means associated therewith, thereby to define the upward stroke limit of said associated writing means, said distance of each said up stop means from said writing tip of said elongate writing means of said array being such as to maintain the writing tips of the entire array of elongate writing means in writing contact with said writing surface.

2. The instrument of claim 1 wherein each said elongate writing means is in the nature of a pen.

3. The instrument of claim 2 wherein said pen is a ball point pen.

4. The instrument of claim 2 wherein said pen is a felt tip pen.

5. The instrument of claim 1 wherein said holder means comprises an upper retainer plate and a lower retainer plate spaced below said upper retainer plate, each said plate being secured to the interior of said enclosure and said plates being correspondingly multiply apertured to receive said elongate writing means therethrough.

6. The instrument of claim 5 wherein said stop table is spaced intermediate said upper and lower retainer plates.

7. The instrument of claim 1 wherein the shape of said enclosure assures use of the instrument in a single rotational plane about its longitudinal axis and wherein said stop table is journalled directly to the enclosure.

8. The instrument of claim 1 wherein the shape of said enclosure enables use of the instrument in multiple rotational planes about its longitudinal axis and wherein said stop table is journalled at its longitudinal center and is pivotable in any plane transverse to the longitudinal axis of the enclosure.

9. The instrument of claim 8 wherein said enclosure is of circular cross section.

10. The instrument of claim 8 wherein said stop table is journalled to a center post secured to said holder means.

11. The instrument of claim 1 wherein each said up stop means is composed of a tough rubbery material.

12. The instrument of claim 1 wherein said array of elongate writing means is in the nature of a single straight row thereof and wherein said journalled stop table comprises a single slot to slidingly capture all of said elongate writing means.

13. The instrument of claim 1 wherein said array of elongate writing means is in the nature of an arcuate row thereof surrounding the centerline of said stop table and wherein said stop table comprises a separate and distinct radial slot for slidingly capturing each said elongate writing means.

14. The instrument of claim 13 wherein said array of elongate writing means is circular.

* * * * *